US006108898A

United States Patent [19]

Holzhauer

[11] Patent Number: 6,108,898

[45] Date of Patent: Aug. 29, 2000

[54] COMMUTATOR MANUFACTURING PROCESS

[75] Inventor: Anton Holzhauer, Sigmaringendorf, Germany

[73] Assignee: Firma Anton Holzhauer Umformtechnik, Sigmaringendorf, Germany

[21] Appl. No.: 08/930,303

[22] PCT Filed: Apr. 17, 1996

[86] PCT No.: PCT/EP96/01607

§ 371 Date: Oct. 21, 1997

§ 102(e) Date: Oct. 21, 1997

[87] PCT Pub. No.: WO96/33534

PCT Pub. Date: Oct. 24, 1996

[30] Foreign Application Priority Data

Apr. 21, 1995 [DE] Germany ..... 195 14 795

[51] Int. Cl.[7] ..... H01R 43/06

[52] U.S. Cl. ..... 29/597; 310/235; 310/237

[58] Field of Search ..... 29/597; 310/235–237

[56] References Cited

U.S. PATENT DOCUMENTS

| | | | |
|---|---|---|---|
| 2,104,141 | 1/1938 | Stevens, Jr. | 29/597 |
| 2,400,590 | 5/1946 | Meyerhoefer | 29/597 |
| 2,688,793 | 9/1954 | Carlson | 29/597 |
| 3,407,491 | 10/1968 | Clevenger et al. | 29/597 |
| 3,468,020 | 9/1969 | Carlson et al. | 29/597 |
| 4,667,394 | 5/1987 | Bode et al. | 29/597 |

FOREIGN PATENT DOCUMENTS

| | | |
|---|---|---|
| 1738657 | 1/1957 | Germany . |
| 3201027 | 7/1983 | Germany . |
| 620930 | 2/1948 | United Kingdom . |
| 738823 | 10/1955 | United Kingdom . |
| 748893 | 5/1956 | United Kingdom . |

*Primary Examiner*—Carl E. Hall

*Attorney, Agent, or Firm*—Nixon Peabody LLP; David S. Safran

[57] ABSTRACT

A process for manufacturing collectors, in particular flat collectors for electric machines. The individual connection elements (2) are at first directly shaped by crowding in a substantially non-machined raw conductive material (1) with their final contour and size and in their final ductile state. For that purpose, a warm forming process is used. The raw material (1) is warmed before the connection elements (2) are formed so that it does not significantly consolidate while the connection elements (2) are formed by crowding, and forming is then carried out in the warm state. In addition, a pot-shaped blank (3) may be shaped, preferably in a cold forming step, for example with inner shaped anchoring elements (6) for an insulating lining. Recesses (9) may be shaped by crowding on the cylindrical envelope (4) of the pot-shaped blank (3). These recesses are associated to the segment divisions and extend almost down to the bottom (5) of the pot-shaped blank (3). In a subsequent forming step, outer anchoring elements (13) are formed on the cylindrical envelope (4), if required a central opening (14) is cut out in the bottom (5) and the previously shaped inner anchoring elements (6) are bent outwards in the radial direction.

18 Claims, 1 Drawing Sheet

COMMUTATOR MANUFACTURING PROCESS

BACKGROUND OF THE INVENTION

The invention relates to a process for producing a commutator, especially a flat commutator, for electrical machinery according to the preamble of patent claim 1.

DE 41 40 475 C2 discloses a process for producing a molded material flat commutator of the aforementioned type. In this case an essentially unmachined raw conductive material is used, preferably in the form of rod material, from which an initial body for example in the form of a round is cut. By means of extrusion this base body is formed into a pot-shaped blank, which has a circular ring-shaped flat part and a tubular jacket adjoining it. In the course of multistage forming inner anchoring elements and outer anchoring elements arranged like a collar are shaped to later reliably anchor to the commutator the molding material which is to be held in the pot-shaped interior of the blank and which is used as the insulating mass. At a later station an annular flange which projects radially to the outside is molded onto the free end of the jacket of the pot-shaped blank by displacement of material in the axial direction against the free end of the jacket. At a further station lug-shaped connection elements are obtained by punching out of the annular flange shaped beforehand. In this punching process the outer anchoring elements are also separated. By punching the connection elements out of the annular flange shaped continuously beforehand, on the free end of the jacket of the blank scrap material results which remains unused, especially the remaining and punched-out connection elements taking only a small fraction of the overall annular flange surface, so that a relatively large amount of material is lost in this production.

Another problem lies in that during the various extrusion treatments and also in the formation of the annular flange material hardening is necessarily caused by the forming so that the connection elements formed are less ductile or bendable than the initial raw material. After completion of the commutator however connecting leads are wound around these connection elements and then the connection elements are bent back onto the outside of the cylindrical jacket. As a result of material embrittlement therefore cracks have occurred in the conventional manner of production and they must generally be expected. The known production process also comprises a host of individual deformation steps, from which an economical method of production of these commutators suffers.

U.S. Pat. No. 3,812,576 whose defects and difficulties will be surmounted with the above discussed DE 41 40 475 C2 discloses a process for producing a commutator for electrical machinery in which, proceeding from a disk-shaped conductive raw material, a cylindrical part is produced which has one open end with a continuous annular flange which projects radially to the outside, and a bottom. By means of pressing, the relieved parts from the interior of the cylindrical section of the cylindrical part are shaped and during subsequent addition of the insulation prevent the adhesion of the insulation to the annular flange or to the outer surface of the bottom. Then the annular flange is machined by punching such that lug-shaped connection elements therefrom remain and the relieved sections and the punched out parts of the annular flange are removed.

Aside from the large number of individual stations, when the lug-shaped connection elements are punched out scrap material results and the individual forming treatments engender the danger that material hardening or embrittlement will occur on the individual, lug-shaped connection elements obtained subsequently by punching out.

SUMMARY OF THE INVENTION

The object of the invention is to make available a process for producing a commutator, especially a flat commutator of the generic type which allows economical and material-saving production and in which especially the connection elements are ductile and bendable after shaping and remain bendable until the bending process is executed while overcoming the above described difficulties.

According to the invention a process for producing a commutator, especially a flat commutator for electrical machinery, is made available; it is produced from an essentially unmachined raw conductive material with the formation of several segments which surround the insulation and which are insulated against one another, with assigned connection elements which project individually radially from the segments, the production process being characterized by the fact that the raw material is formed first for producing the connection elements with a finished outline and size and with a ductile finished state.

In contrast to existing methods of production for commutators, in the process as claimed in the invention, proceeding from the raw material, the individual connection elements are produced by displacement of material by forming. Here it is significant that these connection elements in this forming process have their finished outline and size and are present in a ductile finished state which is maintained as far as subsequent bending treatment. This direct shaping of the individual connection elements on the base body of raw material thus avoids subsequent machining processes such as punching out and the like, since the connection elements formed in this way already have their finished outline and size. Thus, in the process as claimed in the invention no scrap material is formed since a continuous annular flange is not produced, but simply the individual lug-shaped connection elements which project in the radial direction on the outside edge of the base body of raw material. In particular in this way the connection elements are ductile or bendable since prior to other subsequent forming processes they have been shaped and are no longer subjected to deformation which could lead to material hardening or embrittlement. In this way a commutator is economically produced in the process as claimed in the invention, saving material.

According to one preferred process, the raw material before forming to produce the connection elements is heated depending on the selected initial material or raw material such that significant material hardening by forming can be prevented in the formation of the connection elements. In this way the ductility of the shaped connection elements can be improved and their ductility depends essentially on the properties of the raw material.

According to one especially preferred production process according to the invention the connection elements are shaped in the heated state of the raw material, this treatment being called semihot pressing, so that the raw material is transferred directly after heating to the press and the connection elements are shaped in the still hot state. Material forming can optionally take place by forging and/or at the forging temperature. Preferably the connection elements are shaped in the semihot or hot range.

A temperature of roughly 150° C. and higher has proven feasible for heating of the raw material; this of course depends on the raw material used. In particular for copper and its alloys the temperatures which occur hereby are subject to major fluctuations and no absolute temperature values can be given for them. Preferably the raw material is heated to a temperature in the range from roughly 300 to roughly 700° C.

One alternative production method for producing the individual connection elements with a finished outline and size and with a ductile finished state is characterized by the fact that the raw material is annealed before forming to produce the connection elements, the connection elements are produced by cold forming and then annealing treatment is done again. In this way for example the connection elements after shaping can be prevented from becoming less ductile by the material hardening and embrittlement caused during shaping. In any case this production process is time-consuming, since after annealing treatments cooling times must be tolerated.

Proceeding from this state that the raw material has first been formed to produce the individual connection elements according to the aforementioned description, cold forming is then done in which a pot-shaped blank with an essentially cylindrical jacket and essentially flat bottom is shaped. For this region of the commutator material hardening is desirable for reasons of wear; this is obtained in a controlled manner especially in the flat bottom area of the pot-shaped blank by cold forming treatment.

Inner anchoring elements for insulation filling which run essentially axially on the inner surface of the bottom and which are arranged in a collar shape are also shaped by cold forming. Preferably the recesses which are assigned to the segmentation, proceeding from the free edge of the jacket, are produced by material displacement by cold forming. These recesses extend into the vicinity of the inner surface of the bottom of the pot-shaped blank. Preferably the inside width of the recess, proceeding from the free edge of the jacket, can become smaller in the direction of the bottom, and in particular the recesses formed by material displacement are V-shaped. The "tip area" of the respective V-shaped recess is preferably formed by a short straight segment. The number of these recesses corresponds to the number of segments of the commutator and they are assigned to the respective divisions. Since these recesses extend into the vicinity of the inner surface of the bottom of the pot-shaped blank, in the subsequent cutting treatment to separate the individual segments from the flat outer surface of the bottom cutting depths as small as possible are used, so that on the one hand the filled insulation material need not be deeply slit and on the other hand cutting treatment can be done quickly and easily.

On the inner surface of the bottom, narrow, radially running depressions can be shaped; they proceed from the "tip area" of the respective recesses and extend to the center point of the bottom area. Here the cutting depth can be further reduced and is even less than the thickness of the base material of the bottom. Furthermore the depressions cause reliable guidance in cutting and sawing treatment for dividing and separating the segments of the commutator.

According to one preferred method of producing a commutator as claimed in the invention, cold forming is done to produce the pot-shaped blank, to form the inner anchoring elements arranged in a collar shape and the recesses formed by material displacement, and optionally to produce the radial depressions in one station. In this way an especially economical method of manufacture of one such commutator is achieved, since the machining times for cold forming in the production process as claimed in the invention are very short.

Furthermore, in the process according to the invention outer anchoring elements which point radially to the inside from the jacket are produced by cold forming for insulation filling.

If an unperforated conductive raw material is used in the production of the commutator as claimed in the invention, a central opening is punched out for the rotor shaft of the electrical machinery in the bottom of the pot-shaped blank. If a perforated raw material or a rod material with a tubular cross section and large wall thickness is used, this machining step can of course be omitted.

Furthermore, the inner anchoring elements are bent slightly radially to the outside to improve the anchoring action with the insulation added later and the insulation filling.

According to one preferred embodiment of the production process according to the invention treatments to form the outer anchoring elements which point radially inward, to punch out the central opening in the bottom of the pot-shaped blank and bending of the inner anchoring elements radially to the outside take place at one station. In this way the production times for one such commutator can be significantly shortened since viewed overall in the process as claimed in the invention for example essentially only three forming steps are necessary, proceeding from the raw material to the finished commutator without insulation filling and posttreatment or postmachining.

All other machining and treatments such as addition of the insulation, optionally galvanizing the base body and separating the segments by slitting along the segment divisions and attachment of lead wires to the connection elements and their bending can then be done in the conventional manner. The bending process for the connection elements is greatly simplified by the production process according to the invention and crack formation by material embrittlement can be avoided, since the connection elements are in the ductile state without material hardening by the forming processes. Furthermore, the fiber orientation is undisturbed by the forming process so that the commutator can withstand high dynamic stresses which occur especially in motor vehicles.

The production process according to the invention is suitable for production of commutators of varied designs and types and the invention is not limited to the production of flat commutators. However, what is important in the production of all these types of commutators is that the connection elements on the one hand are shaped such that there is no material scrap, and that on the other hand these connection elements are shaped with a finished outline and size and with a finished ductile state likewise at the start of the production process by material displacement. This material displacement takes place, viewed from the raw material—base body for forming the connection elements, in the direction to the outside. Depending on the design of the commutator of course the anchoring elements for the insulation filling can be shaped in a correspondingly modified manner without departing from the patent idea as claimed in the invention, according to which the shaping of the connection elements takes place directly from the raw material by material displacement to the finished outline and size and with a ductile finished state.

The invention is explained below using one preferred embodiment with reference to the attached drawing which however in no way represents a limitation.

DETAILED DESCRIPTION OF THE PREFERRED EMBODIMENTS

The process according to the invention in conjunction with production of a base body for a flat commutator is explained only on one example. Of course commutators of other designs can also be produced and formed in the same or similar manner.

Figure 1:
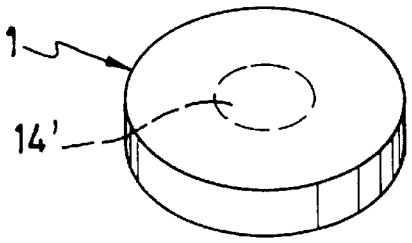
FIG. 1 shows a perspective view of one raw material—base body.

FIG. 1 shows an example of raw material 1 which is essentially unworked. This raw material 1 is shown for example as a flat, massive disk which is sheared off of round rod material and formed. Optionally, in contrasts to FIG. 1, a raw material which is not detailed can also be taken as the initial material which is made for example as an annular disk and already has prefabricated central opening 14', as is shown in FIG. 1 with the broken line. The base body of raw material 1 can alternatively be obtained by punching out a strip material with or without a hole. If a thick-walled tube-rod material is taken as the initial material, the disk can be in the form of a round as raw material 1. All these initial materials can be used as raw material 1 in the process as claimed in the invention and a solid material in the form of a disk is assumed simply as an example for the following explanation. Optionally a round can also be obtained from this solid material disk by punching out a center opening as a type of premachining step (not shown).

Figure 2:
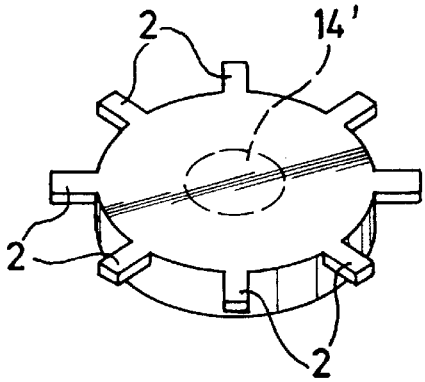
FIG. 2 shows a perspective view in the state with the individual connection elements obtained by forming and material displacement.

Proceeding from raw material 1 as shown in FIG. 1, then first of all individual connection elements 2 are shaped by forming; they are made for example lug-shaped as shown in FIG. 2. These connection elements 2 project radially above the peripheral edge of raw material 1 as shown in FIG. 1 as individual connection elements 2 and they are shaped such that as shown in FIG. 2 they have their finished outline and shape. These connection elements 2 also have their ductile finished state. In particular, according to one preferred production process, raw material 1 is heated before forming connection elements 2 depending on the material properties such that notable material hardening by forming can be prevented. In this heated state, then, connection elements 2 with the finished and final state are shaped. This shaping can, for example, be called semi-hot pressing. Of course, shaping in the normal range is also possible. When the connection elements 2 are shaped, the material of raw material 1 is displaced in the direction to the outside, preferably in the still hot state, and the corresponding forming tools which are used for this purpose have assigned spaces which stipulate and limit the finished outline and size of connection elements 2.

Since the temperatures necessary for this purpose depend on the properties of the conductive material used for raw material 1, especially for example copper alloys, only preferred ranges can be indicated. Here, it has been found that heating to a temperature of roughly 150° C. is feasible. This temperature can of course also be higher. A temperature range from roughly 300 to 700° C. has been preferably found.

Alternatively to semi-hot pressing, cold shaping of connection elements 2 is also considered. Here then, for example, raw material 1 can be annealed, and after cooling, connection elements 2, as shown in FIG. 2, with finished outline and size are then shaped. To achieve the desired ductility of connection elements 2, they can be annealed again individually or the entire base body shown in FIG. 2 can be done.

Figure 3:
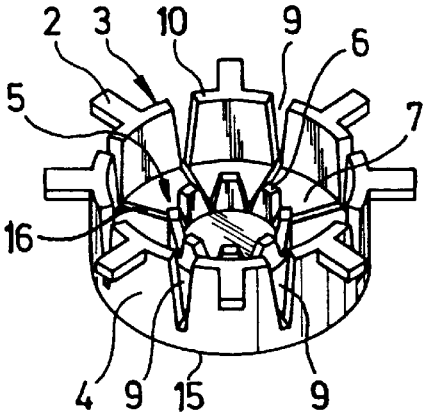
FIG. 3 shows a perspective view for illustrating a pot-shaped blank with inner anchoring elements.

FIG. 3 shows commutator blank 3 which is obtained by cold forming proceeding from the body as shown in FIG. 2. This blank 3 is made pot-shaped and has essentially cylindrical jacket 4 and essentially flat bottom 5. At the same time, in the shaping of pot-shaped blank 3, inner anchoring elements 6 are formed which are arranged in a collar shape on inner surface 7 of bottom 5 of pot-shaped blank 3. As shown, these inner anchoring elements 6 run essentially axially relative to blank 3 and project zig-zagged from inner surface 7 of bottom 5 as spaced.

As described, the forming process takes place proceeding from FIG. 2 to pot-shaped blank 3 as shown in FIG. 3, preferably in a single forming process step. Of course, the forming processes can also optionally be carried out individually in succession.

Optionally, at the same time, with forming treatment, proceeding from FIG. 2 to FIG. 3, a number of recesses 9 can be formed by material displacement. The number of recesses 9 corresponds to the number of the segmentation and in the embodiment shown there are eight such recesses 9. According to the preferred embodiment shown each recess 9 proceeds from one free edge 10 of cylindrical jacket 4 and extends into the vicinity of bottom 5 of pot-shaped blank 3. Preferably the inside width of each recess 9 decreases from free edge 10 to bottom 5. Recesses 9 are therefore made V-shaped and in the apex region preferably have a straight segment. Proceeding from the apex area of each V-shaped recess 9, narrow, bridge-shaped and radially running depressions 16 can be shaped and are assigned to the segmentation and extend in the direction of the center point of bottom 5 on its inner surface 7. The advantage of these recesses 9, and optionally depressions 16, will be explained later. In addition the shaping of recesses 9 and optionally of narrow, radially running depressions 16 can be done with all other forming processes in one cycle so that proceeding from the body shown in FIG. 2 blank 3 for the commutator which is made pot-shaped and which is shown in FIG. 3 is obtained in one cycle.

Figure 4:
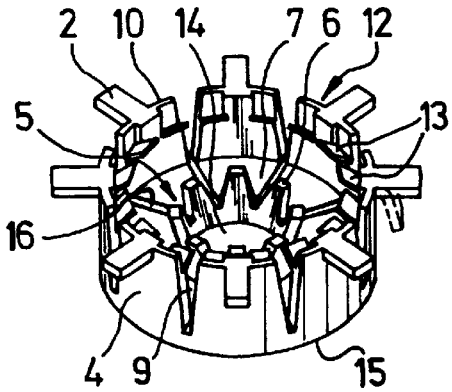
FIG. 4 shows a perspective view of a pot-shaped blank in which there is a central opening and outer anchoring elements are also formed.

In the next step then, another forming process takes place on base body 12 shown in FIG. 4 which is an intermediate product of conductive material in commutator production. This base body 12 has outer anchoring elements 13 which are obtained by cold forming and which are made radially zig-zagged pointing inward in the vicinity of free edge 10 of jacket 4. At the same time when a solid material disk according to raw material 1 as shown in FIG. 1 is used, central opening 14 in bottom 5 of pot-shaped blank 3 can be punched out. This central opening 14 is located in bottom 5 radially within the collar-shaped arrangement of inner anchoring elements 6. Preferably, in this treatment step, inner anchoring elements 6 are bent slightly radially to the outside to improve their anchoring effect.

Although in the example of the invention, proceeding from the body shown in FIG. 3, in one working cycle base body 12 is formed and shaped as the intermediate product in commutator manufacture, of course the treatments can also be carried out individually in succession. If a raw material (not shown) is used which has central opening 14', of course the punching process as per FIG. 4 can be omitted. Central opening 14 shown there is already present and is intended to hold the rotor shaft of an electrical machine which is not detailed.

Proceeding from this base body 12 as per FIG. 4 of conductive material which has been obtained solely by material forming, the commutator can be completely finished by adding and pressing insulation into the interior of pot-shaped blank 3; the insulation is reliably anchored using inner anchoring elements 6 and outer anchoring elements 13 on base body 12. If necessary, galvanization can also be done. Proceeding from flat continuous outer surface 15 of bottom 5, to separate and divide the segments on the commutator cutting is done, only one cutting depth at roughly the material thickness of bottom 5 being necessary, since to separate the segments recesses 9 have already been shaped on the segmentation lines on cylindrical jacket 4. This greatly simplifies subsequent cutting. If, in addition, narrow, radially running depressions 16 are shaped, the cutting depth can be further reduced so that it is even smaller than the base material thickness of bottom 5. In addition, guidance can be achieved in the cutting treatment for segmentation and segment separation.

One such commutator, which is not detailed, is then provided with electrical lines on preferably lug-shaped connection elements 2 which, for example, are wound around the connection elements in one or more turns. Then connection elements 2 are bent back in the direction to the outer surface of cylindrical jacket 4. This bending process can be done simply and without cracking since connection elements 2 are in a ductile or bendable state with undisturbed fiber orientation due to the production process as claimed in the invention. A commutator completed in this way is then installed for example in an electrical machine.

Since these additional treatment steps such as adding of the insulation, slitting of the segments, attachment of lead wires and bending of connection elements 2 are conventional in this area, they are only explained and not detailed. Furthermore they are not the subject of the production process as claimed in the invention.

Although the production of base body 12 which is used as the intermediate product for a commutator, especially for a flat commutator, has been explained above, the step which is especially important as claimed in the invention can of course also be carried out in commutators configured differently in terms of process engineering, according to which first of all connection elements 2 are shaped from raw material 1 by material displacement and have their finished outline and size after shaping, and are present especially in the ductile finished state. All other forming treatments can be chosen in a coordinated manner depending on the desired configuration and size of the commutators to be produced. Furthermore, it is important that base body 12 to be filled with insulation is produced solely by forming treatments from a raw conductive material, and that all these forming treatments can be done with as small a number of working steps as possible, the material hardening caused during cold forming being used to increase the strength of base body 12 in a controlled manner, aside from connection elements 2. In a flat commutator especially outer surface 15 of bottom 5 should exhibit resistance since the brushes of an electrical machine for example run on it.

In particular, in the process according to the invention, connection elements 2 can be shaped to save material since they are shaped directly in finished outline and size without an annular flange being necessary on free edge 10 of cylindrical jacket 4 of pot-shaped blank 3. As a result of preventing scrap material in the production of connection elements 2 the base material costs to be used for production of this commutator can also be reduced by this material reduction to increase the economic efficiency of the production process as claimed in the invention.

What is claimed is:

1. Process for producing a commutator for electrical machinery having a formation with a plurality of projecting segments disposed around an insulating material and insulated relative to one another by the insulating material and with a plurality of connection elements, each of which project radially from a respective one of the projecting segments, comprising the steps of:

shaping the connection elements, with a finished outline and size, and with a ductile finished state, directly from essentially unmachined raw conductive material by material displacement by forming an initial blank of said conductive material having a disc shape with an circular peripheral wall, and by deforming the initial blank to deform material radially outward of said peripheral wall, thereby creating said connection elements radially projecting on the peripheral wall of the blank; and cold forming the blank with the radially projecting connection elements from its disc shape into a pot-shaped blank with an essentially cylindrical jacket and an essentially flat bottom.

2. Process as claimed in claim 1, further comprising the step of heating the raw material prior to said shaping step to prevent significant material hardening during the shaping step.

3. Process as claimed in claim 2, wherein the connection elements are shaped in the heated state of raw material by semi-hot pressing during said shaping step.

4. Process as claimed in claim 2, wherein the raw material is heated to a temperature of at least roughly 150° C. during said heating step.

5. Process as claimed in claim 2, wherein the raw material is heated to a temperature in a range from about 300° C. to about 700° C. during said heating step.

6. Process as claimed in claim 1, comprising the steps of annealing the raw material prior to said shaping step, and annealing the material again subsequent to said shaping step; and wherein said shaping step is performed by cold forming.

7. Process as claimed in claim 1, wherein inner anchoring elements which run essentially axially from an inner surface of the bottom of the pot-shaped blank and which are arranged in a collar shape are also produced by said cold forming step.

8. Process as claimed in claim 1, wherein recesses between the segments are produced, proceeding from a free edge of the jacket, by material displacement during said cold forming step.

9. Process as claimed in claim 8, wherein the recesses are formed extending into a vicinity of the inner surface of the bottom of the pot-shaped blank during said cold forming step.

10. Process as claimed in claim 9, wherein the recesses are formed with a shape having a width which becomes smaller in an axial direction from the free edge of the jacket toward said bottom.

11. Process as claimed in claim 10, wherein each recess is made roughly V-shaped in said axial direction.

12. Process as claimed in claim 8, wherein narrow depressions are shaped on an inner surface of the bottom, each depression running radially from a respective recess in a direction toward a center point of the bottom.

13. Process as claimed in claim 9, wherein said cold forming is performed in a single cycle.

14. Process as claimed in claim 1, wherein outer anchoring elements which point radially inwardly from the jacket are produced during said cold forming step.

15. Process as claimed in claim 14, wherein said cold forming is performed in a single cycle.

16. Process as claimed in claim 1, further comprising the step of punching out a central opening for a rotor shaft from the bottom of the potshaped blank.

17. Process as claimed in claim 7, wherein the inner anchoring elements are bent slightly radially outwardly during said cold forming step.

18. Process as claimed in claim 17, wherein said cold forming is performed in a single cycle.

* * * * *